US009091082B2

(12) United States Patent
Wakebe

(10) Patent No.: US 9,091,082 B2
(45) Date of Patent: Jul. 28, 2015

(54) ROOFING MATERIAL

(71) Applicant: NIPPON STEEL & SUMIKIN COATED SHEET CORPORATION, Tokyo (JP)

(72) Inventor: Takahiko Wakebe, Hyogo (JP)

(73) Assignee: NIPPON STEEL & SUMIKIN COATED SHEET CORPOATION, Tokyo (JP)

( * ) Notice: Subject to any disclaimer, the term of this patent is extended or adjusted under 35 U.S.C. 154(b) by 0 days.

(21) Appl. No.: 14/354,701

(22) PCT Filed: Nov. 1, 2012

(86) PCT No.: PCT/JP2012/078381
§ 371 (c)(1),
(2) Date: Apr. 28, 2014

(87) PCT Pub. No.: WO2013/065800
PCT Pub. Date: May 10, 2013

(65) Prior Publication Data

US 2014/0250818 A1 Sep. 11, 2014

(30) Foreign Application Priority Data

Nov. 2, 2011 (JP) ..... 2011-241055

(51) Int. Cl.

| | |
|---|---|
| ***E04D 1/00*** | (2006.01) |
| ***E04F 13/08*** | (2006.01) |
| ***E04D 1/06*** | (2006.01) |
| ***E04D 3/30*** | (2006.01) |
| ***E04D 3/365*** | (2006.01) |

(52) U.S. Cl.
CPC ..... *E04F 13/0894* (2013.01); *E04D 1/06* (2013.01); *E04D 3/30* (2013.01); *E04D 3/365* (2013.01)

(58) Field of Classification Search
CPC ..... E04F 2201/0153; E04F 2201/0115; E04F 3/362; E04F 3/363; E04F 3/364
USPC ..... 52/519, 528, 533, 588.1
See application file for complete search history.

(56) References Cited

U.S. PATENT DOCUMENTS 1,122,492 A * 12/1914 Galbraith ..... 52/522
1,329,794 A * 2/1920 Moomaw ..... 52/531

(Continued)

FOREIGN PATENT DOCUMENTS

DE 2 309 415 9/1973
JP 63-201122 U 12/1988

(Continued)

OTHER PUBLICATIONS

International Search Report for the Application No. PCT/JP2012/078381 mailed Dec. 11, 2012.

*Primary Examiner* — Adriana Figueroa
(74) *Attorney, Agent, or Firm* — Cheng Law Group, PLLC

(57) ABSTRACT

An approximately planar roofing material body is arranged adjacent to another roofing material body. A side end part of the roofing material body is overlapped and laid to the another roofing material body. The roofing material body is provided with an inclined piece formed at a side end edge part of the roofing material body so as to be inclined downward. Further, a tip of the inclined piece (an inclined-piece tip) of the roofing material body is formed so as to abut on a front face bent downward of the another roofing material body laid to a downside of the roofing material body.

2 Claims, 3 Drawing Sheets

(56) References Cited

U.S. PATENT DOCUMENTS

| | | | | | |
|---|---|---|---|---|---|
| 1,559,967 | A * | 11/1925 | King | 52/522 |
| 2,211,508 | A * | 8/1940 | Little | 52/533 |
| 4,819,398 | A * | 4/1989 | Dameron | 52/529 |
| 5,524,409 | A * | 6/1996 | Kaiser | 52/588.1 |
| 5,752,355 | A * | 5/1998 | Sahramaa | 52/539 |
| 8,033,070 | B2 * | 10/2011 | Morello et al. | 52/462 |
| 2003/0029126 | A1 * | 2/2003 | Wetzel et al. | 52/716.8 |
| 2007/0289245 | A1 * | 12/2007 | Welch | 52/592.1 |

FOREIGN PATENT DOCUMENTS

| | | | |
|---|---|---|---|
| JP | 2002-316971 | A | 10/2002 |
| JP | 2008-174921 | A | 7/2008 |

* cited by examiner

ROOFING MATERIAL

TECHNICAL FIELD

The present invention relates to a roofing material such as a metal roofing material.

BACKGROUND ART

Conventionally, a plurality of roofing materials are laid on a roof bed in longitudinal and lateral directions, thereby a roof being formed. In this case, the roofing materials adjacent to each other in the lateral direction (a direction orthogonal to a water-flow direction of the roof) are laid so as to be shifted from each other by a predetermined length in the lateral direction and be overlapped to each other in an up and down direction, and attempt to secure waterproof of the roof after construction (for example, see Patent Literature 1). Specifically, as shown in FIG. 6, an approximately planar cover part 40 is formed at one side end part of a roofing material A, and a sacrificed part 41 has an approximately waved cross section and is formed at the other side end part of the roofing material A. The sacrificed part 41 of the roofing material A laid on the roof bed 6 is covered with the cover part 40 of the other roofing material A. Therefore, the two roofing materials A and A are attempted to be laid adjacent to each other in the lateral direction.

CITATION LIST

Patent Literature

Patent Literature 1: JP 2002-316971 A

SUMMARY OF INVENTION

Technical Problem

However, there is a problem that the roofing material A laid as above-mentioned has small stiffness in the longitudinal direction thereof (that is, the water-flow direction of the roof). Therefore, a front face of the roofing material A bends or curves over approximately an entire length in the longitudinal direction with a wind load or the like, which is added to a front face side of the roofing material A. Then, when a deflection occurs to the roofing material A as above-mentioned, in the roof at which the roofing materials A and A are laid so as to be overlapped to each other in the up and down direction as above-mentioned, a gap occurs between a tip of a side end part of an upside roofing material A and a front face of a downside roofing material A. Accordingly, there is a fear that rainwater or the like is entered from the gap occurring as above-mentioned, and waterproof of the roof decreases. Further, there is also a fear that design gets worse by the gap.

The present invention has been made in the light of the above-mentioned circumstances, and the object of the present invention is to provide a roofing material, which is superior to workability when the roofing material is laid on the roof bed or the like and is hard to decrease the waterproof of the roof.

Solution to Problem

A roofing material according to one aspect of the present invention includes an approximately planar roofing material body arranged adjacent to another roofing material body, and a side end part of the roofing material body is overlapped and laid to the another roofing material body. The roofing material body is provided with an inclined piece formed at a side end edge part of the roofing material body so as to be inclined downward, and a tip of the inclined piece of the roofing material body is formed so as to abut on a front face bent downward of the another roofing material body laid to a downside of the roofing material body.

In addition, preferably, the tip of the inclined piece is protruded and bent downward so as to have a central part formed in an approximately straight line, and both end parts formed in curved lines.

Advantageous Effects of Invention

The roofing material according to one aspect of the present invention is superior to the workability when the roofing material is laid on the roof bed or the like and is hard to decrease the waterproof of the roof.

DESCRIPTION OF EMBODIMENTS

The following describes an embodiment of the present invention.

A metal plate is processed by a roll forming process or the like, thereby a roofing material A according to the present invention being able to be formed in a desired shape. For example, preferably, a thickness of the metal plate is 0.3 to 0.5 mm, and a weight per area of the metal plate is 4.7 to 5.0 kg/m$^2$. In addition, the metal plate may be used from among various varieties such as a coated steel plate, a galvanized steel sheet, and a coated Galvalume steel plate (a registered trademark). A conventional roofing material is produced with only a roll former. However, the roofing material according to the present embodiment is able to be produced with a vender process machine because the roofing material according to the present embodiment needs hardly a rounding processing (a curved surface processing). In addition, an end part is able to be formed by a hemming processing and a press processing.

Figure 1:
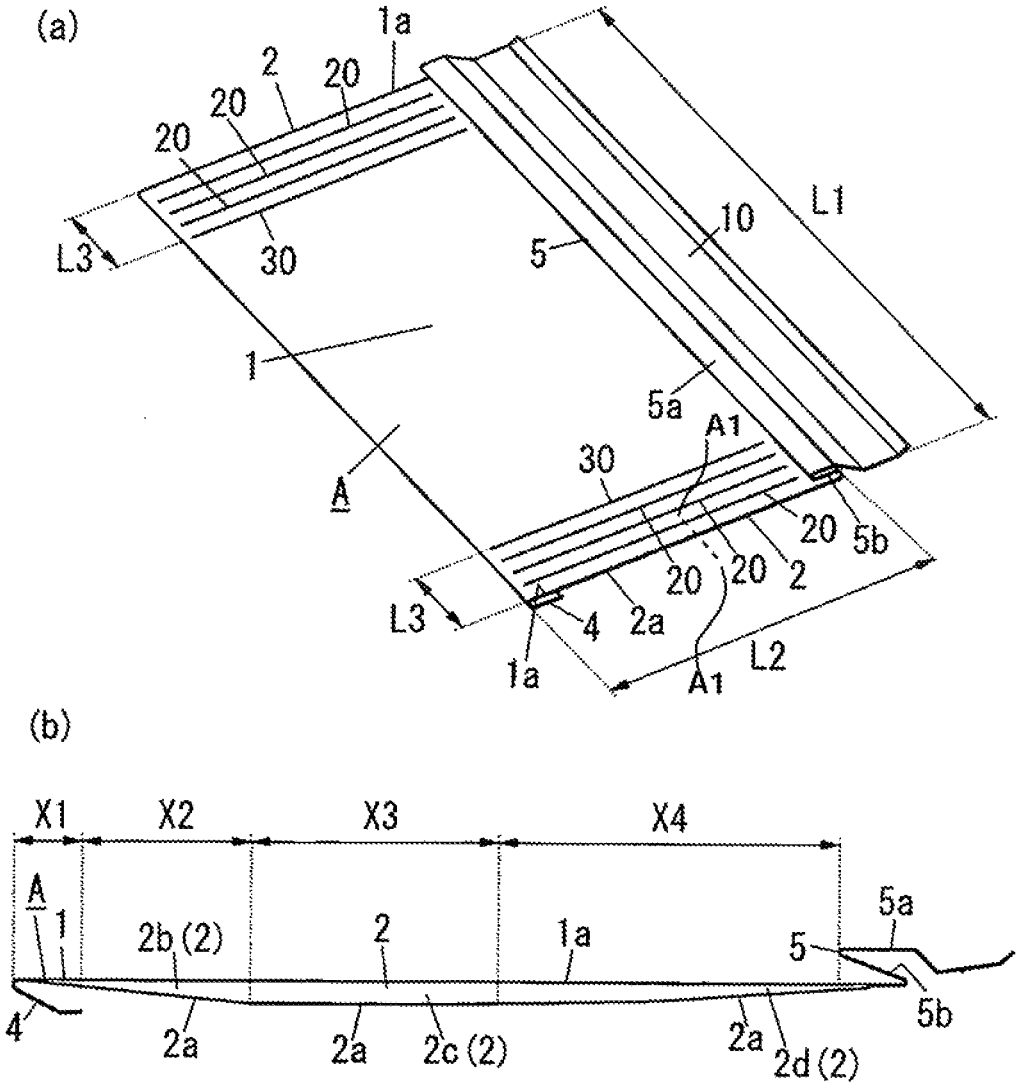
FIG. 1(*a*) is a perspective view of one example of a roofing material according to an embodiment of the present invention, and FIG. 1(*b*) is a side view of the one example of the rooting material, as seen from a short length side thereof, according to the embodiment of the present invention.

As shown in FIGS. 1(*a*) and 1(*b*), the roofing material A according to the present invention is formed in bilateral symmetry (line symmetry). The roofing material A includes a roofing material body 1 and inclined pieces 2. The inclined pieces 2 are disposed at both side end parts in a right and left direction of the roofing material body 1. In addition, the roofing material A may include a locked part 4, a locking part 5, and a fixing piece 10.

The roofing material body 1 is formed to extend longer in a lateral direction (a direction orthogonal to a water-flow direction of a roof or a direction orthogonal to an inclined direction of the roof). A length dimension L1 in the lateral direction is a specified length that may to be set to, for example, about 2000 mm, but is limited to this length. On the other hand, a length dimension L2 in a longitudinal direction (the water-flow direction of the roof or the inclined direction) of the roofing material body 1 may be set to, for example, 200 to 280 mm, and preferably, is set to about 250 mm.

Figure 2:
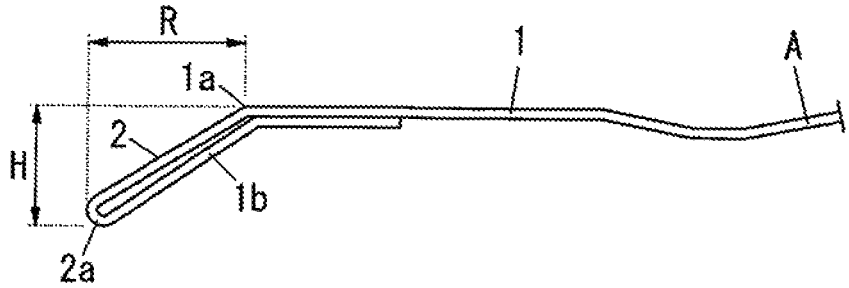
FIG. 2 is a cross-sectional view of a side end part of the roofing material or near the side end part, as seen in a longitudinal direction thereof, said cross-section being taken along dashed line A1-A1 of FIG. 1(*a*)

The roofing material body 1 is provided with the inclined pieces 2 and 2 that are disposed at side end edge parts 1*a* and 1*a* in a right and left direction (the lateral direction) of the roofing material body 1 across an approximately entire length in the longitudinal direction (the water-flow direction of the roof) of the roofing material body 1. As shown in FIG. 1(*b*), the inclined pieces 2 are formed so that tips of end parts of the roofing material body 1 are bent and inclined downward (a direction toward a roof bed 6 described below when the roofing material body 1 is laid on the roof bed 6). Therefore, for example, as shown in FIG. 2, the both side end parts of the roofing material A are formed so that the roofing material A, as seen from a downstream side of the roof, has an approximately L-shape as a cross-sectional shape. Here, the downstream side means a down direction side in the inclined direction of the roof, and an upstream side means an up direction in the inclined direction of the roof.

When the inclined pieces 2 are formed, at first, as shown in FIG. 2 (a cross-section of a side end part as seen from a longitudinal side of the roofing material A), side ends of the roofing material body 1 are replicated and bent to a back face side, thereby being formed doubly so as to be overlapped to each other in an up and down direction. Then, the parts formed doubly are further bent at an approximately center thereof, and thereby, the inclined pieces 2 should be formed. In this case, approximately L-shaped reinforcing pieces 1*b*, which are formed by turned up to the back face side, increases stiffness of end parts of the roofing material A.

As showing in FIG. 1(*b*), each of the inclined pieces 2 is formed so as to be divided into areas of a covered side part 2*b*, a central part 2*c*, and a laid side part 2*d*. Specifically, the covered side part 2*b* is formed at a side of a downstream-side end part (for example, an eave side end part) of the roofing material A. The laid side part 2*d* is formed at a side of an upstream-side end part (for example, a ridge side end part) of the roofing material A. The central part 2*c* is formed so as to be located between the covered side part 2*b* and the laid side part 2*d*. The covered side part 2*b* and the laid side part 2*d* may be referred to as a front end part 2*b* and a back end part 2*d*, respectively.

Here, an angle between the roofing material body 1 and the inclined piece 2 (it is referred to as a minor angle here) may be set to, for example, 120 to 150° across the entire length of the inclined piece 2. Preferably, an angle between the central part 2*c* and the roofing material body 1 is set to about 140°. An angle between the laid side part 2*d* and the roofing material body 1 and an angle between the covered side part 2*b* and the roofing material body 1 are set to about 120°.

The covered side part 2*b* is formed so as to have a bent height H that is gradually longer as the covered side part 2*b* is closer to the central part 2*c*. As shown in FIG. 2, the bent height H described here means a minimum distance between a face of the roofing material body 1 and a face, which passes through a tip of the inclined piece (hereinafter, referred to as a inclined-piece tip 2*a*) and is parallel to the roofing material body 1. The central part 2*c* is formed so that a bent height H thereof is approximately constant, that is, the side end edge part 1*a* of the central part 2*c* is approximately parallel to the inclined-piece tip 2*a*. In addition, the laid side part 2*d* is formed so as to have a bent height H that is gradually longer as the laid side part 2*d* is closer to the central part 2*c*.

Here, a part, which is located at a side of the covered side part 2*b*, of the inclined-piece tip 2*a* may be formed in either a straight line or a curved line. A part, which is located at a side of the central part 2*c*, of the inclined-piece tip 2*a* is formed in a straight line. In addition, a part, which is located at a side of the laid side part 2*d*, of the inclined-piece tip 2*a* may be formed in either a straight line or a curved line similar to the inclined-piece tip 2*a* of the covered side part 2*b*. When being formed in the straight line, the inclined-piece tip 2*a* of the area of the laid side part 2*d* may be bent once near a central point. The inclined-piece tip 2*a* is formed as above-mentioned, thereby having a shape so that the inclined-piece tip 2*a* is protruded and bent downward.

Then, a width dimension R of the inclined piece 2 may be set within a range of 4 to 9 mm across the entire length of the inclined piece 2. Preferably, a width dimension R of the central part 2*c* may be set to about 6 mm, and width dimensions R of the laid side part 2*d* and the covered side part 2*b* may be set to about 7 mm. As shown in FIG. 2, each width dimension R described here means a minimum distance between the side end edge part 1*a* and the face, which passes through the inclined-piece tip 2*a* and is perpendicular to the roofing material body 1.

Here, the bent height H of the central part 2*c* may be set to, for example, 3 to 7 mm, and preferably, is set to about 5 mm. On the other hand, when the part, which is located at the covered side part 2*b*, of the inclined-piece tip 2*a* is formed in a curved line, a radius of curvature thereof may be set to 300 to 500 mm, and preferably, is set to about 400 mm. In addition, when the part, which is located at the laid side part 2*d*, of the inclined-piece tip 2*a* is formed in a curved line, a radius of curvature thereof may be set to 1000 to 1500 mm, and preferably, is set to about 1200 mm. In this case, in the roofing materials A and A adjacent to each other as described below, it is possible to easily prevent a gap from being formed between overlapped parts.

Then, the width dimensions (a length in the water-flow direction of the roof) of the covered side part 2*b*, the central part 2*c*, and the laid side part 2*d* may be set to 40 to 60 mm, 50 to 100 mm, and 80 to 120 mm, respectively, and preferably, are set to 40 mm, 60 mm, and 100 mm, respectively.

Here, in FIG. 1(*b*), when the roofing material body 1 has a 251 mm of length dimension L2 in the longitudinal direction, and length dimensions X1, X2, X3, and X4 are 20 mm, 40 mm, 60 mm, and 100 mm, respectively. A bent height H at a point, which is away from an end part of the roofing material A by a sum of 20 and 40 mm, may be set to 3 mm. A bent height H, which is away from the end part of the roofing material A by a sum of 20, 40, and 60 mm, may be set to 6 mm. A bent height H, which is away from the end part of the roofing material A by a sum of 20, 40, 60, and 100 mm, may be set to 3 mm. In this case, as described below, it is possible to easily prevent the gap from occurring between the inclined-piece tips 2*a* located at an upside and the roofing material body 1 located at a downside.

As shown in FIG. 1(*a*), the roofing material body 1 may be provided with a plurality of projection parts 20, which are formed approximately parallel to each other at both end edge parts of the roofing material body 1. In this case, each projection part 20 may be formed as a groove. The groove is opened in a front face of the roofing material body 1 by rib processing, and has an approximately V-shaped cross section. Each projection part 20 protrudes toward a back face of the roofing material body 1 and is formed across an approximately entire length of the roofing material body 1 in the longitudinal direction. For example, a width of each projection part 20 may be set to 4 to 10 mm, a depth from the front face of each projection part 20 may be set to 0.5 to 1.5 mm, and a length of each projection part 20 may be set to 180 to 280 mm. Preferably, the projection part 20 is formed so that a width dimension L3 from the inclined-piece tip 2*a* to the projection part 20 is within a range of 100 to 200 mm. Each projection part 20 may protrude and be formed toward the front face of the roofing material body 1. Both two types of projection parts 20 may be formed, one type projection part 20 protrudes toward the front face of the roofing material body 1, and the other type projection part 20 protrudes toward the back face of the roofing material body 1.

The roofing material body 1 may include positioning parts 30. Each positioning part 30 is formed to be opened in the back face of the roofing material body 1 by rib processing and have an approximately V-shaped cross section. Each positioning part 30 protrudes toward the front face of the roofing material body 1 and is formed across the approximately entire length of the roofing material body 1 in the longitudinal direction. One or more positioning parts 30 may be disposed at each for the both side parts of the roofing material body 1. When the one positioning part 30 is disposed at each of the both side parts of the roofing material body 1, the one positioning part 30 may be formed at a position that is away from the inclined-piece tip 2*a* by a predetermined dimension. For example, the one positioning part 30 may be formed at a position that is 100 mm away from the inclined-piece tip 2*a*. When the plurality of positioning parts 30 are disposed at each for the both side parts of the roofing material body 1, the plurality of positioning parts 30 may be formed at constant intervals from the inclined-piece tip 2*a*. For example, the positioning parts 30 are formed at intervals of 100 mm from the inclined-piece tip 2*a* in the lateral direction. The one or more positioning parts 30 may be formed in any shapes or at any positions as long as the positioning parts 30 are visible.

The locked part 4 is formed at a downstream-side end part (for example, the eave side end part) of the roofing material body 1. A part of the metal plate disposed to extend from the downstream-side end part of the roofing material body 1 is bent so as to be turned up to the back face side of the downstream-side end part of the roofing material body 1, thereby the locked part 4 being formed across the approximately entire length of the roofing material body 1 in the lateral direction.

The locking part 5 is formed at an upstream-side end part (for example, the ridge side end part) of the roofing material body 1. A part of the metal plate disposed to extend from the upstream-side end part of the roofing material body 1 is bent so as to be turned up to the front face side of the upstream-side end part of the roofing material body 1, thereby the locking part 5 being formed to have an approximately inverted U-shaped cross section including an upper piece 5*a* and a lower piece 5*b*. Accordingly, the locking part 5 is formed to protrude toward the downstream side from the upstream-side end part of the roofing material body 1 in an upside of the roofing material body 1. The locking part 5 is formed to have the approximately inverted U-shaped cross section so that the downstream-side end part of the locking part 5 is closed, and the upstream side of the locking part 5 is opened.

The fixing piece 10 may be formed with a part of the metal plate disposed to protrude from the upstream-side end part of the locking part 5. The fixing piece 10 is formed across the approximately entire length in the lateral direction of the roofing material body 1. The fixing piece 10 is formed to have an approximately L-shape as a cross-sectional shape in the longitudinal direction. The fixing piece 10 is disposed to protrude toward the upstream side from the upper piece 5*a* of the locking part 5.

Then, the roofing materials A according to the present embodiment are laid on the roof bed 6 such as a roofing board in the longitudinal and lateral directions. Accordingly, the roof is able to be formed. In this case, the roofing materials A and A, which are laid adjacent to each other, are coupled to each other to secure mounting strength and increase waterproof.

Figure 3:
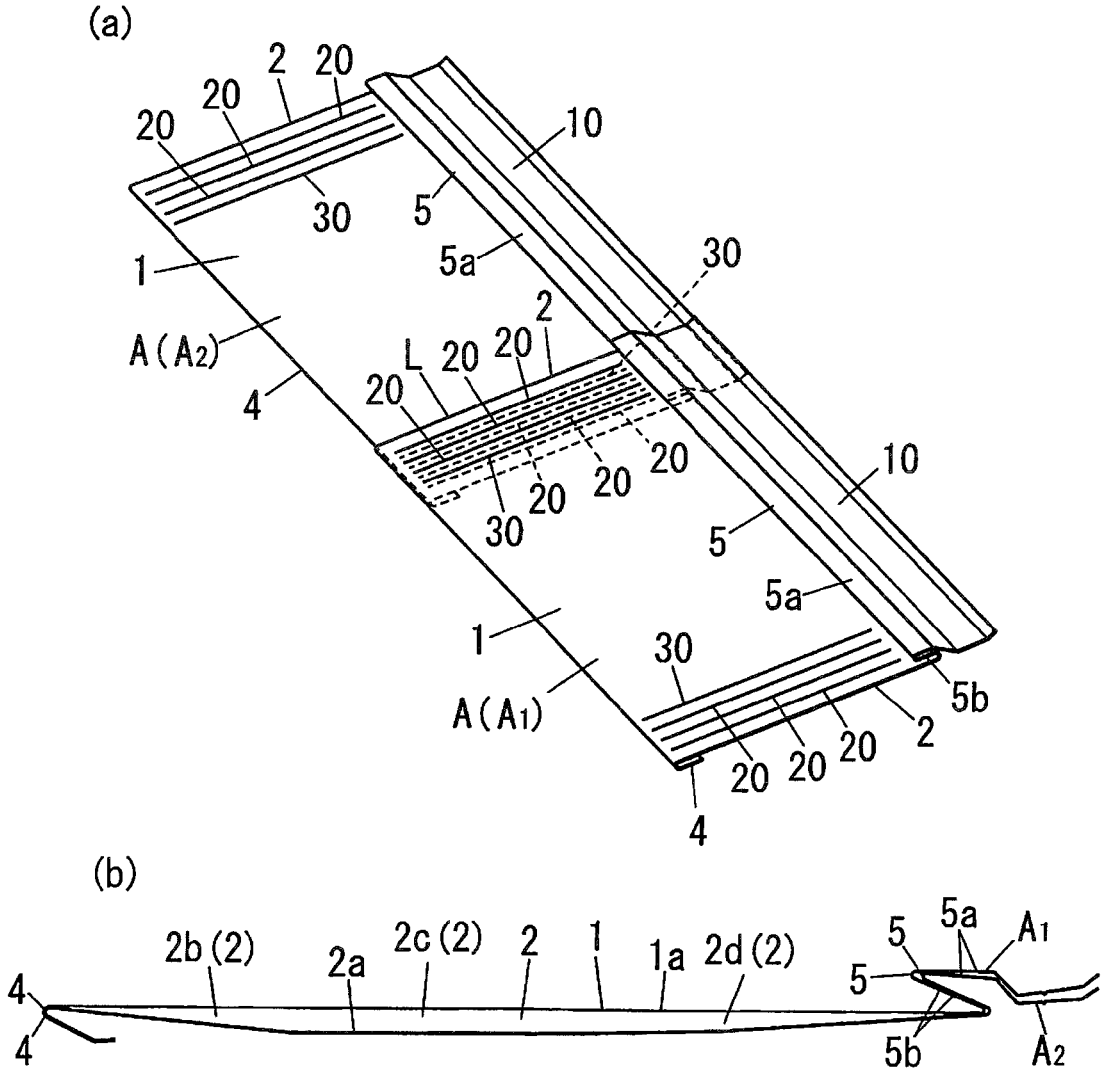
FIG. 3(*a*) is a perspective view of one example of a coupled state of the roofing material according to the embodiment of the present invention, and FIG. 3(*b*) is a cross-sectional view of a coupled part, as seen from a side thereof, of the one example of the coupled state of the roofing material according to the embodiment of the present invention.

In the roofing materials A according to the present embodiment, as shown in FIGS. 3(*a*) and 3(*b*), the inclined piece 2 of one roofing material A is overlapped, in the up and down direction, to a front face of the roofing material body 1 of the other roofing material A, and the one roofing material A is coupled to the other roofing material A.

In the roofing materials A according to the present embodiment, when the one roofing material A and the other roofing material A piles in the up and down direction as described above, the inclined-piece tip 2*a* of an upper roofing material A (referred to as $A_1$ in FIGS. 3(*a*) and 3(*b*)) is designed to abut on a front face of the roofing material body 1 of a lower roofing material A (referred to as $A_2$ in FIGS. 3(*a*) and 3(*b*)) across the approximately entire length in the longitudinal direction. As described above, when the roofing material A is disposed on the roof bed 6, curvature occurs to the roofing material A in the longitudinal direction by wind load (or walking of a worker during construction). That is, when a force such as a wind load is added to the front face of the roofing material A, the roofing material A comes to bend backward along the longitudinal direction. Accordingly, the roofing material A comes to become a state in which the roofing material A is curved downward (a back-face direction) (a state in which the roofing material A is curved along the longitudinal direction). This is a phenomenon occurring by a reason that stiffness of the roofing material A against the bending along the longitudinal direction is not very strong.

However, in the present embodiment, the inclined-piece tip 2*a* of the roofing material A is formed to be protruded and bent downward as described above. Therefore, as shown in FIG. 3(*b*), the inclined-piece tip 2*a* of the upper roofing material $A_1$ is designed to be capable of abutting along the front face that is bent in the longitudinal direction of the roofing material body 1 of the lower roofing material $A_2$. Accordingly, adhesion increases, between the inclined-piece tip 2*a* of the upper roofing material $A_1$ and the roofing material body 1 of the lower roofing material $A_2$, and therefore, it is possible to easily prevent the gap from being formed between the both roofing materials. Therefore, the roofing materials A and A adjacent to each other in the lateral direction are able to suppress that rainwater enters through the overlapped parts thereof, and then have higher waterproof.

In addition, a degree of deflection generated when the roofing material A is laid on the roof bed 6 is constant regardless of the length dimension L1 in the lateral direction and the length dimension L2 in the longitudinal direction of the roofing material body 1. Therefore, even if the roofing material A is formed to have an arbitrary dimension, the inclined piece 2 of the roofing material A is able to follow deflection.

As described above, in the present embodiment, even if the roofing material A is laid on the roof bed 6 and the deflection occurs, the roofing material A overlapped at the up-side is formed to be capable of following the above-mentioned deformation, and it is hard to form the gap between the overlapped parts of the roofing materials A and A adjacent to each other in the lateral direction. Therefore, although a conventional roofing material A is reinforced by a heat insulator such as urethane or polystyrene to prevent deflection of the conventional roofing material A, the roofing material A according to the present embodiment does not need to be reinforced by pasting such a heat insulator. Accordingly, because the roofing material A according to the present embodiment has no reinforce by the heat insulator, it is possible to decrease weight of the entire roof, to easily perform laying operation, and also to decrease a cost.

In addition, in the roofing materials A and A adjacent to each other in the lateral direction, when the gap occurs between the upper inclined-piece tip 2*a* and the lower roofing material body 1, a shadow would occur by the gap. Therefore, appearance of the roof itself would get worse. However, the roofing material A according to the present embodiment is able to suppress that the gap is formed. Accordingly, it is hard that appearance gets worse, and it is possible to improve design.

In the roofing material A according to the present embodiment, the inclined-piece tip 2*a* of the roofing material A is formed in the above-mentioned shape. Accordingly, it is possible to perform easily construction for overlapping the inclined-piece tip 2*a* to the roofing material body 1 of the lower roofing material A. That is, because the inclined-piece tip 2*a* is formed to abut on the bent front face of the roofing material body 1 of the other lower roofing material A, it is possible to easily engage the inclined-piece tip 2*a* in the roofing material body 1 of the lower roofing material A. Accordingly, in the roofing material A according to the present embodiment, it is possible to perform laying construction smoothly and also improve workability.

In the present embodiment, because the inclined-piece tip 2*a* of the upper roofing material A is formed to abut along the bent front face of the roofing material body 1 of the lower roofing material A, an overlapped dimension of parts, in which the upper roofing material A and the lower roofing material A are overlapped to each other, is capable of being set arbitrarily. That is, even if the overlapped dimension is changed, the inclined piece 2 abuts along the bent front face of the roofing material body 1. An upper limit of the overlapped dimension is not set particularly. However, if the overlapped dimension is too large, useless parts increase in the roofing materials A. Accordingly, in this view point, preferably, the overlapped dimension is set equal to or shorter than a half of a lateral dimension of the roofing material body 1. Further preferably, the roofing material bodies 1 are overlapped to each other so that the overlapped dimension is within a range of 100 to 200 mm from the side end edge parts 1*a* of the roofing material bodies 1. In addition, because each roofing material A is bilateral symmetry, in the case where the roofing materials A and A adjacent to each other in the lateral direction may be overlapped to each other, a right roofing material A may be located at an upside of a left roofing material A, or the left roofing material A may be located at an upside of the right roofing material A. Therefore, the roofing materials A and A adjacent to each other in the lateral direction are laid on the roof bed 6 in turn from any of right and left directions in the lateral direction of the roof bed 6.

Figure 4:
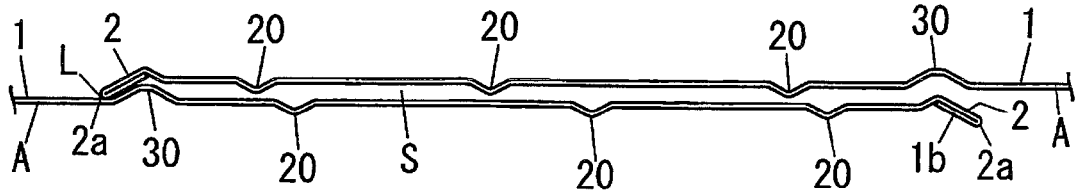
FIG. 4 is a cross-sectional view of the coupled part of the one example of the coupled state, as seen in the longitudinal direction, of the roofing material.

On the other hand, when each of the roofing materials A includes the positioning part 30, and the roofing materials A and A adjacent to each other in the lateral direction are overlapped in the up and down direction, the positioning part 30 may be used as a guide (a target). For example, as shown in FIG. 4, the positioning part 30, which is included in the one roofing material A of the roofing materials A and A adjacent to each other in the lateral direction, may be overlapped to the inclined piece 2 included in the other roofing material A. As described above, overlapped positions of the roofing materials A and A adjacent to each other in the lateral direction are able to be regulated with the positioning part 30 as the guide. Accordingly, in the entire roof, it is easy to arrange regularly boundary lines (joints) L, each which is formed between an inclined piece 2 of a roofing material body 1 of an upper roofing material A and a front face of a roofing material body 1 of a lower roofing material A, in which the upper and lower roofing materials A are adjacent to each other in the lateral direction. Therefore, for example, in a plurality of roofing materials A, A, . . . adjacent to each other in the longitudinal and lateral directions, if roofing materials A and A adjacent to each other in the lateral direction are overlapped and abut on each other so that the boundary lines L of roofing materials A and A adjacent to each other in the longitudinal direction are arranged in a straight line, it is hard that irregular joints is formed at the roof. Therefore, there is an advantage that the appearance of the roof is hard to decrease.

Then, when each roofing material A includes the projection parts 20, a gap S is able to be formed, by the projection parts 20, between the roofing materials A and A overlapped to each other in the up and down direction. That is, as shown in FIG. 4, the projection parts 20 included in the upper roofing material A are mounted on a flat area formed at the front face of the roofing material body 1 of the lower roofing material A. Therefore, it is possible to form the gap S between a front face of the roofing material body 1 of the lower roofing material A and a back face of the roofing material body 1 of the upper roofing material A. Normally, in the present embodiment, as described above, because the inclined-piece tip 2*a* contacts the roofing material body 1, it is hard that rainwater enters through the overlapped parts of the roofing materials A. Even if the rainwater enters, for example, due to the inclined piece 2 being damaged by aged deterioration, it is possible to discharge the rainwater through the gap S. Accordingly, preferably, to form the gap S surely, in the roofing materials A and A overlapped to each other in the up and down direction, the projection parts 20 included in the upper roofing material A are not overlapped to the projection parts 20 included in the lower roofing material A. If the projection parts 20 protrude toward the front face of the roofing material body 1, a flat area formed at the back face of the roofing material body 1 of the upper roofing material A is mounted on upper ends of the projection parts 20 disposed at the roofing material body 1 of the lower roofing material A. Therefore, it is possible to form the gap S similar to the above. In addition, the roofing materials A and A adjacent to each other in the longitudinal direction are coupled to each other so that the parts thereof are overlapped to each other in the up and down direction. In this case, a locked part 4 included in the roofing material A laid at the upstream side (for example, a ridge side) is locked in a locking part 5 included in the roofing material A laid at the downstream side (for example, an eave side).

Figure 5:
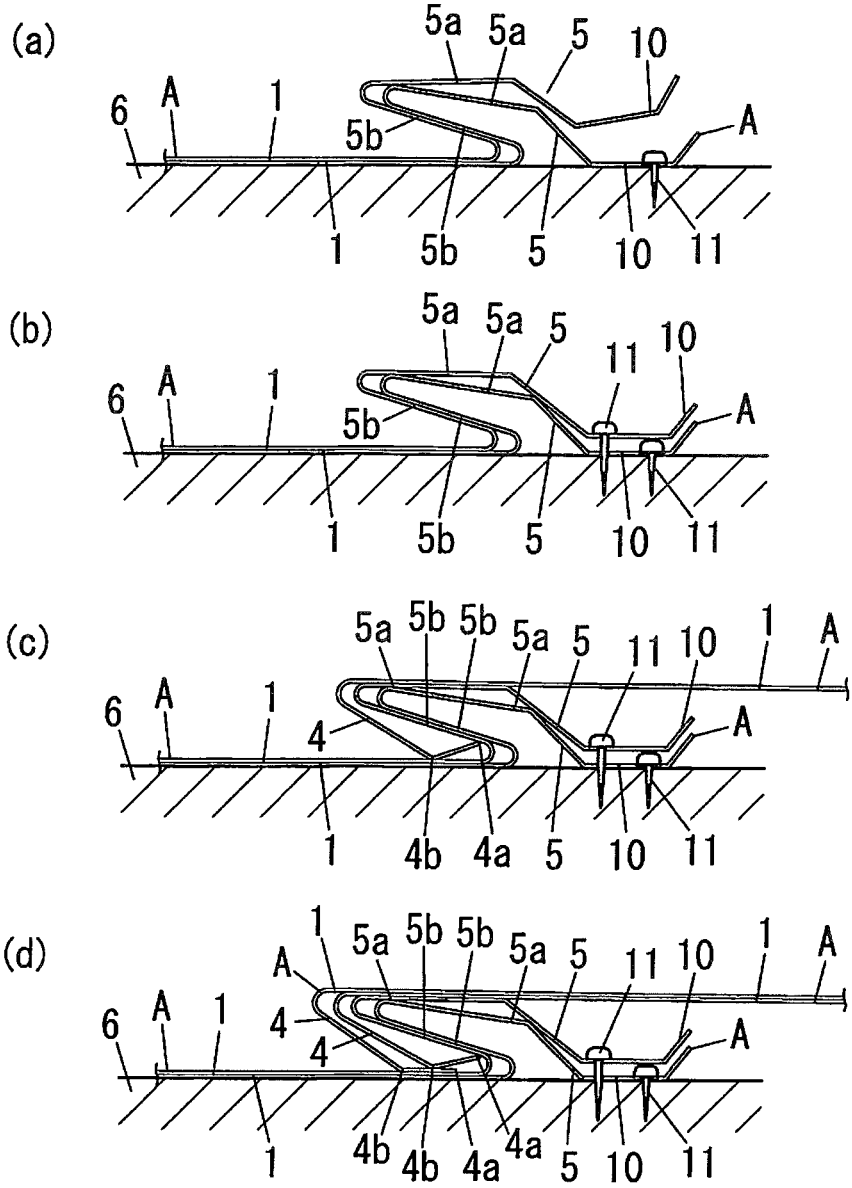
FIGS. 5(*a*) to 5(*d*) are a partial cross-sectional view illustrating one example of a construction process of the roofing material, as seen from a side, according to the embodiment of the present invention.
Figure 6:
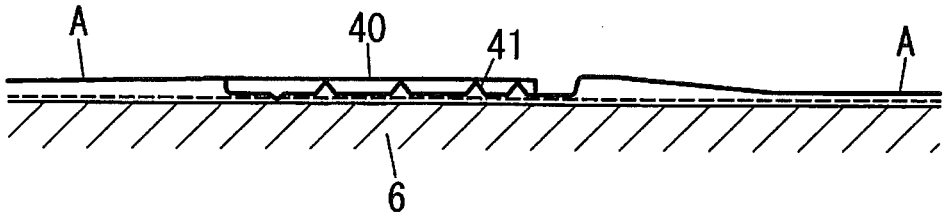
FIG. 6 PRIOR ART
FIG. 6 is a partial cross-sectional view illustrating a coupled state of a conventional example.

Here, connections of the roofing materials A and A in the longitudinal and lateral directions are described in detail (see FIGS. 5(*a*) to 5(*d*)). First, the roofing material A is mounted on the roof bed 6 in a state where the locking part 5 extends upward. Then, a fixture 11 such as a screw is knocked into a fixing piece 10 and the roof bed 6 to fix the fixing piece 10. The fixing piece 10 is fixed as described above, and therefore, it is possible to fix (determine) a shape of the locking part 5 in a state where the locking part 5 contracts in the up and down direction, and an up and down dimension (a thickness) thereof is kept to be short. Next, the fixed roofing material A is mounted with another roofing material A so that another roofing material A and the fixed roofing material A are arranged in the lateral direction. At this time, as described above, the roofing materials A and A adjacent to each other are overlapped to each other in the up and down direction and coupled to each other in a state where the roofing materials A and A are shifted from each other in the lateral direction. In addition, the locking part 5 of the fixed roofing material A is inserted, from the upstream side, between an upper piece 5*a* and a lower piece 5*b* of a locking part 5 of a roofing material A disposed anew. Therefore, as shown in FIG. 5(*a*), a front face of the locking part 5 of the fixed roofing material A is covered with the locking part 5 of the roofing material A disposed anew. Furthermore, a front face of the fixing piece 10 of the fixed roofing material A is covered with a fixing piece 10 of the roofing material A disposed anew. Next, as shown in FIG. 5(*b*), a fixture 11 is knocked into the fixing pieces 10 of the fixed roofing material A and the roofing material A disposed anew. Therefore, the fixing piece 10 of the roofing material A disposed anew is fixed on the roof bed 6.

After the roofing materials A, A, . . . are laid in a row as above-mentioned, other roofing materials A, A, . . . are laid, in turn, in a row at the upstream side of the laid roofing materials A, A, . . . . At this time, as shown in FIG. 5(*c*), a locked part 4 of the upstream-side roofing material A is inserted between a roofing material body 1 and the locking part 5 of the downstream-side roofing material (a roofing material located at an upside) A, and then, the inserted locked part 4 is locked at a lower face of the locking part 5. Then, as shown in FIG. 5(*d*), a locked part 4 of further another upstream-side roofing material A is inserted between the locked part 4 of the upstream-side roofing material A and the roofing material body 1 of the downstream-side roofing material A, thereby being locked at the locking part 5 of the downstream-side roofing material A. Finally, a part, at which four roofing materials A are adjacent to one another in the longitudinal and lateral directions as described above, is in a state where two locked parts 4 and 4 and two locking parts 5 and 5 are overlapped to one another. The roofing materials A are laid in the longitudinal and lateral directions as above-mentioned, and accordingly, it is possible to form the roof.

REFERENCE SIGNS LIST

A: a roofing material
1: a roofing material body
1*a*: a side end edge part
2: an inclined piece
2*a*: an inclined-piece tip (a tip of an inclined piece)

The invention claimed is:

1. A roofing material comprising an approximately planar roofing material body arranged adjacent to another roofing material body, a side end part of the roofing material body being overlapped and laid to the another roofing material body, wherein the roofing material body is provided with an inclined piece formed at a side end edge part of the roofing material body in a first direction so as to be inclined downward, a tip of the inclined piece of the roofing material body being formed so as to abut on a front face bent downward of the another roofing material body laid to a downside of the roofing material body, wherein the inclined piece is formed so as to be divided in the second direction into areas including a central part and two end parts, so that a central part is lower than two end parts in a second direction orthogonal to the first direction in a plan view, and wherein the side end part of the roofing material body is overlapped and laid to the another roofing material body while the tip of the inclined piece of the roofing material body abuts the front face of the another roofing material body.

2. The roofing material according to claim 1, wherein the tip of the inclined piece is protruded and bent downward so as to be formed in an approximately straight line at the central part, and formed in curved lines at the two end parts as viewed from the first direction.

* * * * *